US006065333A

United States Patent [19]

Aschmann et al.

[11] Patent Number: 6,065,333

[45] Date of Patent: May 23, 2000

[54] DEVICE FOR MONITORING A MOVING YARN

[75] Inventors: Alfred Aschmann, Zumikon; Rolf Fritzsche, Wetzikon; Peter Schilling, Siebnen, all of Switzerland

[73] Assignee: Zellweger Luwa AG, Switzerland

[21] Appl. No.: 08/709,531

[22] Filed: Sep. 6, 1996

[30] Foreign Application Priority Data

Sep. 6, 1995 [CH] Switzerland ..... 2552/95

[51] Int. Cl.[7] ..... G01N 33/36

[52] U.S. Cl. ..... 73/160

[58] Field of Search ..... 73/160

[56] References Cited

U.S. PATENT DOCUMENTS

| | | | |
|---|---|---|---|
| 4,302,721 | 11/1981 | Urbanek et al. | 324/226 |
| 4,512,028 | 4/1985 | Stutz | 377/16 |
| 5,054,317 | 10/1991 | Laubscher | 73/160 |
| 5,178,008 | 1/1993 | Aemmer | 73/160 |
| 5,499,794 | 3/1996 | Aeppli | 73/160 |
| 5,636,803 | 6/1997 | Aschmann et al. | 242/36 |

FOREIGN PATENT DOCUMENTS

| | | | |
|---|---|---|---|
| 0423380 | 4/1991 | European Pat. Off. . | |
| 0598521 | 5/1994 | European Pat. Off. . | |
| 0628647 | 12/1994 | European Pat. Off. . | |
| 680310 | 7/1992 | Switzerland . | |
| 2192722 | 1/1988 | United Kingdom | 73/160 |

*Primary Examiner*—Hezron Williams
*Assistant Examiner*—Willie Morris Worth
*Attorney, Agent, or Firm*—Burns, Doane, Swecker & Mathis

[57] ABSTRACT

The invention relates to a device for monitoring a yarn (1), which is moving in its longitudinal direction, using a measuring head and an evaluation unit (7) which is spatially separate from and connected to the measuring head. To enable optimum use of measuring heads operating according to different physical principles without unduly increasing the outlay, the measuring head includes a first part (2) operating according to a first measuring principle and having a connection (5) to a first part (6) of the evaluation unit for making an evaluation according to the first measuring principle. The measuring head then comprises a further part (9) operating according to a further measuring principle and having a releasable connection (8, 10) to the first part. In addition, the evaluation unit likewise comprises a further part connected by a releasable connection for the evaluation according to the further measuring principle.

8 Claims, 2 Drawing Sheets

DEVICE FOR MONITORING A MOVING YARN

FIELD OF THE INVENTION

The invention relates to apparatus for monitoring a yarn which is moving in its lengthwise direction. Such apparatus uses a measuring head for sensing a characteristic of the yarn and an evaluation unit spatially separate from and connected to the measuring head.

BACKGROUND OF THE INVENTION

Known devices for monitoring a moving yarn operate according to the capacitive or optical measuring principle. Depending on their measuring principle, such devices each have their preferred area of application and are geared quite specifically to such area of application.

U.S. Pat. No. 5,054,317 discloses a device for monitoring and/or measuring parameters of a continuous wire-like or fiber-like test material, in which both a capacitive measuring element and an optical measuring element are disposed in a measuring gap. The two measuring elements form two measuring zones which may overlap one another. This arrangement of multiple measuring elements in the same measuring gap calls for a mutual adaption of the two measuring systems, which leads to compromises and so does not allow the individual measuring systems to operate to optimum advantage.

Another perceived drawback in such known systems is that, depending on whether one or the other or even both measuring principles are to be used to monitor the yarn, a device specifically geared to the particular application has to be provided. For the manufacturer, this means that he has to develop and supply a plurality of designs, which therefore also entails an increased logistical outlay.

OBJECTS AND SUMMARY OF THE INVENTION

An object of the present invention is to provide apparatus in which multiple measuring elements operating according to different physical principles or measuring different parameters may be used in an optimum manner without increasing the required constructional and logistical outlay, to guarantee exceptional flexibility of application while in operation.

This object may be achieved in apparatus that includes a measuring head having a first part operating (for example) according to a first measuring principle, and an evaluation unit having a first part for evaluating the signals from the first part. A second part of the measuring head operating (for example) according to a second measuring principle is connectable by a releasable connection to the first part of the measuring head. Finally, the evaluation unit also has a second part, connected by a releasable connection, for evaluating signals from the second part, e.g. according to a second measuring principle. The measuring head and the evaluation unit may optionally additionally comprise third and further parts for additional flexibility of application.

The result is a modular construction. For example, an optical measuring head may serve as a basic head and a capacitive measuring head may be mountable as an attachment, for example, on the basic head. In the process of connecting the two, a continuous measuring gap is produced for the basic head and the further measuring head. The evaluation units are not part of the measuring head and, for spatial reasons, may not be situated in the immediate vicinity of the measuring head. These also have a comparable modular construction with a basic evaluation unit for the basic head and an additional, plug-on evaluation unit for the further measuring head. A common connection line is then provided for both measuring heads and evaluation units.

A particular advantage achieved by the invention is that the production of such devices may be standardized to a greater degree for there are only a few measuring heads and evaluation units which are tuned to one another and, at times, have the same dimensions. For the user wishing to install such devices in his yarn spinning frames, for example, there is increased flexibility because he does not immediately have to decide whether he would like to install, for example, an optical or a capacitive measuring system. He may initially install a first measuring system and later acquire the second or further measuring systems and retrofit the spinning frame. He may alternatively install two or three measuring systems together and activate one or the other measuring system depending on the yarn or allocate a specific task to each measuring system. Where required, one of the two measuring systems may be dismantled, deactivated or otherwise removed. A switchover between both measuring systems may be effected at any time, even during operation. Thus, for example, one measuring system may monitor the uniformity of the yarn and the other measuring system the extraneous fibres or impurities in the yarn.

A further advantage is that physical quantities, which are measured in both parts of the measuring head or otherwise arise, do not influence one another. Each part may be designed purposefully and specifically for detecting a specific textile quantity. It is then also possible, when evaluating the signals from the parts of the measuring head, to derive further textile quantities. A somewhat "three-dimensional" measurement of the yarn may be achieved with the aid of such derived quantities, with it being possible to determine parameters such as, for example, the volume, density, structure of the yarn etc.

BRIEF DESCRIPTION OF THE DRAWINGS

These and other features and advantages of the invention will be more fully understood from consideration of the following detailed description of embodiments, illustrated in the accompanying drawings, in which.

DETAILED DESCRIPTION OF THE PREFERRED EMBODIMENTS

Figure 1:
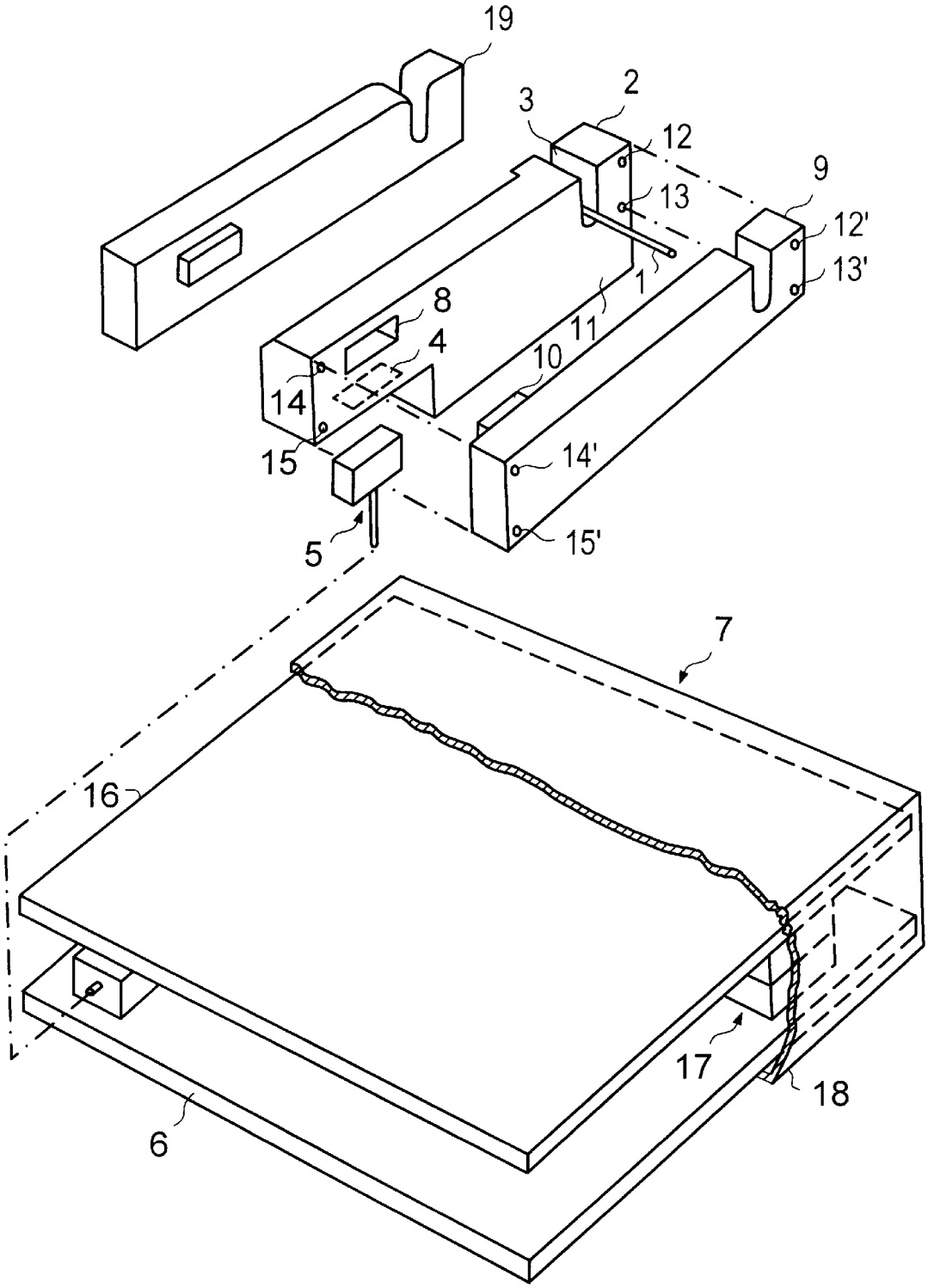
FIG. 1 is a simplified perspective view of a device according to the invention.

In FIG. 1, a first part 2 of a measuring head for a yarn 1 may be seen. The yarn 1 is moved in manner known per se lengthwise through a measuring gap 3. The first part 2 includes a terminal 4 with a plug-and-socket connection for a connection 5 to a first part 6 of an evaluation unit 7. The evaluation unit 7 is illustrated here diagrammatically by its mother boards on which electronic components, which are known per se but not shown here, are disposed and form an evaluation circuit.

The first part 2 of the measuring head likewise comprises a terminal 8 for a plug-and-socket connection to a second part 9 of the measuring head. A complementary accessory 10 to the terminal 8 is provided in the second part 9. In the state of readiness for operation, the second part 9 rests against a side surface 11 of the first part 2, and is releasably connected to such first part mechanically, e.g. by screw connections 12', 12, 13, 13', 14, 14', and 15, 15'. The electrical connection of the two parts 2 and 9 of the measuring head is effected by means of the plug-and-socket connection 8, 10. The external shape of the measuring head with its two parts 2 and 9 is preferably selected and dimensioned so as to enable it to be added onto the currently known spinning and spooling frames in the same manner as an individual sensor previously was. In an identical manner, a further part 19 may also be added onto the first or second part.

A comparable construction is provided for the evaluation unit 7, in which the first part 6 and a second part 16 are connected electrically by a plug-and-socket connection 17 and mechanically by plug-in or screw connections 40, 40 not shown in detail here. The two parts 6 and 16 may also be accommodated in a common housing 18, part of which is diagrammatically indicated here. Here too, the construction may be extended to further parts.

Figure 2:
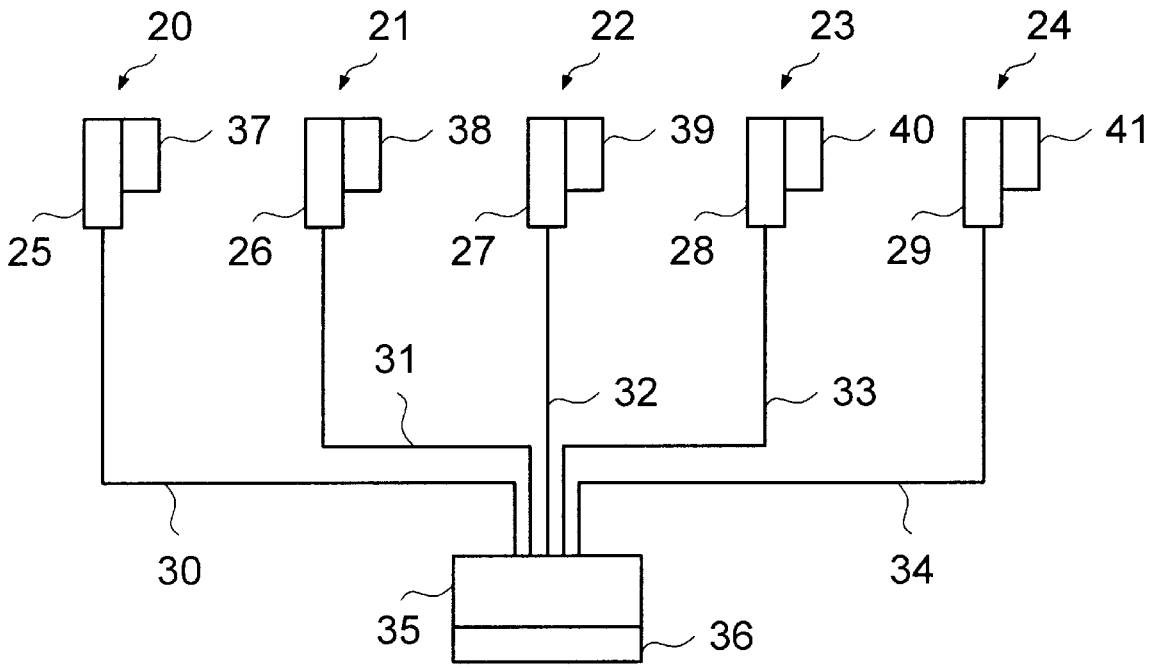
FIG. 2 is a diagrammatic view of a further construction of the device.

With such a device, the most diverse parameters such as mass of the yarn, uniformity of the yarn, impurity content or extraneous fibre content of the yarn etc. may be determined in a manner known per se. It is possible moreover to have the first part 2 of the measuring head determine a first parameter, e.g. the mass of the yarn, and the second part 9 determine the extraneous fibre content of the yarn. In such a case the first and second parts 6, 16 of the evaluation unit 7 are also geared to the determination of the same respective parameters. The evaluation unit 7 in a manner known per se is designed to evaluate electric signals which are supplied by one or more parts 2, 9, operating optically, capacitively or according to some other principle. The evaluation unit converts such signals into measured values. FIG. 2 shows a construction in which, at working points 20, 21, 22, 23, 24 of a spinning or spooling frame, respective first parts 25, 26, 27, 28, 29 of measuring heads are connected in each case by a line 30, 31, 32, 33, 34 to a single, common first part 35 of an evaluation unit. The latter here also comprises a common second part 36 for second parts 37, 38, 39, 40, 41 of the measuring heads. As already described with reference to Fig.1, the second parts 36–41 are releasably connected to the first parts 25–29 and 35.

With a construction according to the invention it is possible to assemble a measuring head system which provides basic parts 2, 6 for frequently requested measurements and attachment parts 9, 16 for more specific or less frequent measurements. The basic parts 2, 6 and the attachment parts 9, 16, except for their interconnection and possibly their power supply, form autonomous units from a mechanical and electronic viewpoint. In an installation comprising a plurality of spinning or spooling frames which are equipped with basic parts of the measuring heads and evaluation units, it is therefore also possible for an individual working point or a frame to be equipped with attachment parts only on a temporary basis in order to carry out a specific task. By exchanging the attachment parts between individual working points or frames it is also easier to find out whether a fault has occurred at the measuring system or at the frame. Thus, equipping of the frames with such measuring head systems may be effected gradually, thereby allowing the textile manufacturer, for a low outlay, to participate in the continuing technical development in the field of yarn measurement and monitoring.

What is claimed is:

1. Apparatus for monitoring a yarn in an operating yarn spinning or spooling frame while the yarn is moving in its lengthwise direction through a working point in such spinning or spooling frame, comprising a measuring head and an evaluation unit spatially separate from the measuring head; said measuring head comprising a first part for sensing said moving yarn according to a first operating principle and producing electrical signals in response thereto, said first part being adapted for addition onto said spinning or spooling frame adjacent the thread path at said working point and including a side surface and a first measuring gap in one edge portion thereof through which said yarn passes;

a second part for sensing said moving yarn according to a second operating principle and producing electrical signals in response thereto; said second part resting against said side surface and being releaseably attached directly to said first part and having a second measuring gap in an edge portion thereof in alignment with said first measuring gap, said second part being electrically connected to said first part through a plug and socket connection;

said evaluation unit being connected electrically to said first part of said measuring head and comprising a first part for evaluating electrical signals produced by said first part of said measuring head, a second part for evaluating electrical signals produced by said second part of said measuring head, and means providing a releasable mechanical and electrical connection of said second part of said evaluation unit to said first part of said evaluation unit.

2. Apparatus according to claim 1, wherein said first operating principle operates capacitively.

3. Apparatus according to claim 1, wherein the second operating principle operates optically.

4. Apparatus according to claim 1, wherein said first part of said measuring head is used to monitor a first parameter and said second part of said measuring head is used to monitor a second parameter.

5. Apparatus according to claim 1, including multiple ones of said measuring heads each being provided for a different working point in said spinning or spooling frame, and wherein said evaluation unit comprises a common first part for a plurality of first parts of said multiple measuring heads and a common second part for a plurality of second parts of said multiple measuring heads.

6. Apparatus for monitoring a yarn in an operating yarn spinning or spooling frame while the yarn is moving in its lengthwise direction through a working point in such spinning or spooling frame, comprising a measuring head and an evaluation unit spatially separate from the measuring head; said measuring head comprising a first part for sensing a first property of said moving yarn and producing electrical signals in response thereto, said first part being adapted for attachment to said spinning or spooling frame adjacent the thread path at said working point and including a side surface and a first measuring gap in one edge portion thereof through which said yarn passes;

a second part for sensing a second property of said moving yarn and producing electrical signals in response thereto; said second part resting against said side surface and being releaseably attached directly to said first part and having a second measuring gap in an edge thereof in alignment with said first measuring gap, said second part being electrically connected to said first part through a plug and socket connection; and said evaluation unit being connected electrically to said first part of said measuring head and comprising a first evaluation unit part for evaluating electrical signals produced by said first part of said measuring head, a second evaluation unit part for evaluating electrical signals produced by said second part of said measuring head, and means providing a releasable mechanical and electrical connection of said second evaluation unit part to said first evaluation unit part.

7. Apparatus according to claim 6, wherein said first parts of said measuring head and said evaluation unit are designed to operate according to a first measuring principle and said second parts are designed to operate according to a second measuring principle.

8. In a yarn spinning or spooling for processing a plurality of yarns each moving in its lengthwise direction through a working point in said spinning or spooling frame, yarn monitoring apparatus comprising a plurality of measuring heads and an evaluation unit spatially separate from said measuring heads; said measuring heads comprising a plurality of first parts each adapted to sense one of said moving yarns capacitively and producing electrical signals in response thereto, each of said first parts including a side surface and a first measuring gap in one edge portion thereof through which the yarn passes;

a plurality of second parts for sensing said moving yarns optically and producing electrical signals in response thereto; each of said second parts resting against said side surface of a corresponding first part and being releaseably attached directly to such first part and having a second measuring gap in an edge thereof in alignment with said first measuring gap in such first part, each of said second parts being electrically connected to its corresponding first part through a plug and socket connection; and said evaluation unit being connected electrically to all of said first parts of said measuring heads and comprising a first part for evaluating electrical signals produced by said first parts of said measuring heads, a second part for evaluating electrical signals produced by said second parts of said measuring heads, and means providing a releasable mechanical and electrical connection of said second part of said evaluation unit to said first part of said evaluation unit.

* * * * *